United States Patent [19]

Grenko

[11] Patent Number: 4,623,159

[45] Date of Patent: Nov. 18, 1986

[54] ROLLER SKATE

[76] Inventor: Joseph Grenko, R.R. 3, Box 386, Muscatine, Iowa 52761

[21] Appl. No.: 732,998

[22] Filed: May 13, 1985

Related U.S. Application Data

[63] Continuation-in-part of Ser. No. 566,012, Dec. 27, 1983, abandoned.

[51] Int. Cl.[4] ..... A63C 17/02

[52] U.S. Cl. ..... 280/11.27

[58] Field of Search ..... 280/11.26, 11.27, 11.28, 280/87.02, 607

[56] References Cited

U.S. PATENT DOCUMENTS

| | | | |
|---|---|---|---|
| 2,424,072 | 7/1947 | Allred | 280/11.28 |
| 4,103,917 | 8/1978 | Widolf | 280/11.28 |
| 4,278,264 | 7/1981 | Lenz | 280/11.28 |

*Primary Examiner*—Richard A. Bertsch

*Attorney, Agent, or Firm*—Henderson & Sturm

[57] ABSTRACT

An improved roller skate construction in which the front and rear shoe-receiving parts of the skate frame are carried respectively on front and rear wheeled axles through the medium of front and rear socket and pedestal structures. Each pedestal is received in its downwardly-opening socket in such fashion that the upper end of the pedestal supportingly engages the closed upper end of the socket to enable limited rocking between the axle and its associated frame part. Each socket and pedestal structure is supplemented by a rearwardly extending tongue on the front axle and a forwardly extending tongue on the rear axle, these being pivoted on the axes of the respective axles. Each tongue is connected to its associated support by a ball and socket joint whose axis is below the interengaging ends of the pedestal and pedestal socket, further augmenting and controlling the relative rocking between the axles and the frame as the skater accomplishes arcuate patterns, etc.

6 Claims, 12 Drawing Figures

Fig. 1
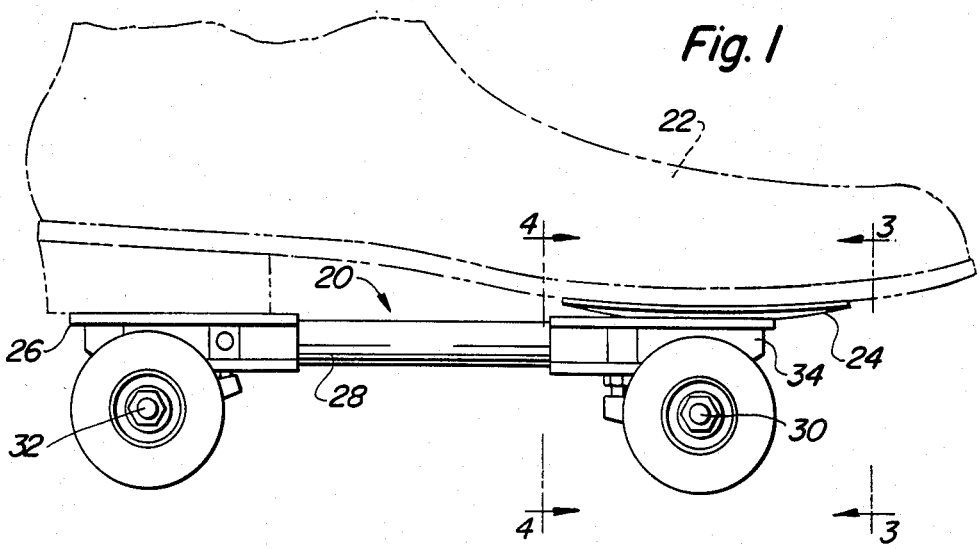
Fig. 2
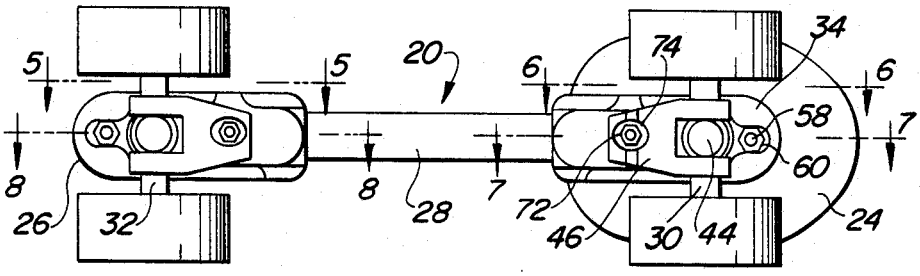
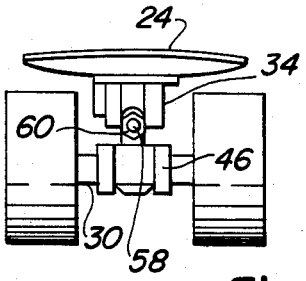
Fig. 3
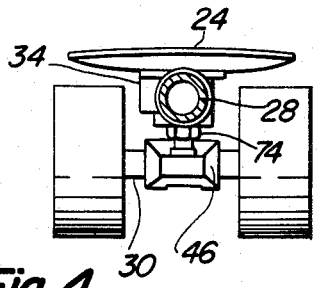
Fig. 4

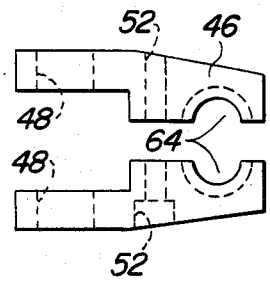
Fig. 9
Fig. 10
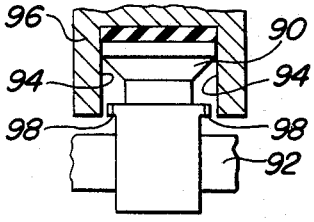
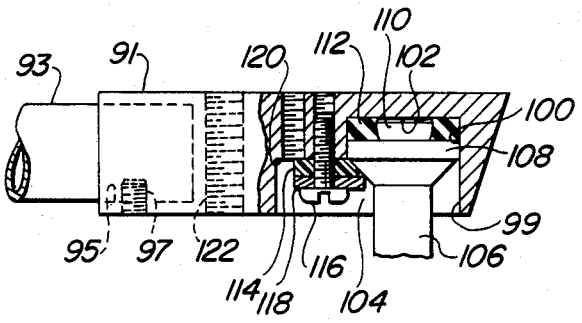
Fig. 11
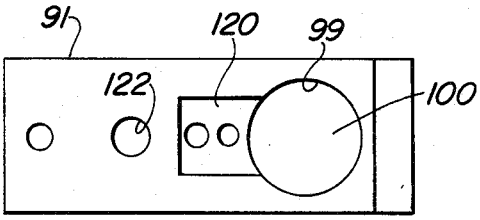
Fig. 12

ROLLER SKATE

This application is a continuation-in-part of copending application Ser. No. 566,012, filed Dec. 27, 1983 now abandoned.

BACKGROUND AND SUMMARY OF THE INVENTION

Many types of roller skate designs exist, all achieving in one fashion or another provision for enabling "steering" of the front and rear wheels. Usually this is accomplished by some form of pivotal connection on an inclined axis, as in the U.S. Pat. No. 2,424,072, to Allred, the axes being arranged so that the front and rear wheels steer oppositely to follow what may be termed generally an arc, according to the skater's pattern. Some pivotal structures are defective or undesirable because they include biasing means which return the axles or trucks to straight-ahead position as soon as the skater's weight is removed from the skate; thus, when the skater applies his weight again to the skate while still in a curve or arc, he must overcome this bias to continue his pattern. Also, adjustment of the pivot axis changes the distance between the foot plate and the axles of the wheels. In many prior designs, the relative rocking is not properly designed, resulting in, among other things, premature wear of the skate wheels.

According to the present invention, an improved skate construction is provided by front and rear structures, each incorporating pedestal and socket means. Each of the front and rear frame parts of the skate has a depending socket, cylindrical about an upright axis and closed at its upper end and opening downwardly at its lower end to the associated axle. Each axle is rigid with the lower part of a column or pedestal, the upper end of which seats in the closed end of the socket. For each axle, there is a fore-and-aft tongue, pivoted at one end to the pedestal-axle combination on a transverse axis, preferably the axis of the axle. Also preferably, this axis intersects with the pedestal axis. The terminal end of the tongue has a ball socket which receives the lower ball end of an upright member threaded into the associated support. The parts are so dimensioned as to enable limited rocking of the axle and its parts about at least a generally fore-and-aft axis. In the case of the front part of the skate, the tongue extends to the rear at about the level of the axle and has a ball and socket connection with the associated support rearwardly of the pedestal and socket structure. The ball is below the level of the interengaging upper ends of the pedestal and socket so that an upwardly and forwardly inclined pivot axis is provided, in effect. In the case of the rear axle, the tongue extends forwardly and the construction just described is substantially repeated except that the rear axle steering is opposite to that of the front axle.

The construction is of simple and inexpensive design and provides a smoother-running, more easily controlled skate. The design is such as to require very little maintenance, which leads to a longer and trouble-free life. The axles can be individually adjusted as to steering. These and further features of the invention will become apparent from the following description and accompanying drawings.

DESCRIPTION OF THE DRAWINGS

FIG. 1 is a side elevation of a roller skate embodying the invention, a typical mounted shoe being shown in broken lines.

FIG. 2 is a bottom view of the skate as shown in FIG. 1.

FIG. 3 is a front view as seen along the line 3—3 on FIG. 1.

FIG. 4 is a section as seen along the line 4—4 on FIG. 1.

FIG. 9 is an "exploded" view of the tongue element of the axle means.

FIG. 10 is a fragmentary section of a modified pedestal-to-frame mounting.

FIG. 11 is a longitudinal section of a modified form of frame part and pedestal arrangenent.

FIG. 12 is a bottom view of the front part per se.

DETAILED DESCRIPTION OF A PREFERRED EMBODIMENT OF THE INVENTION

Figure 6:
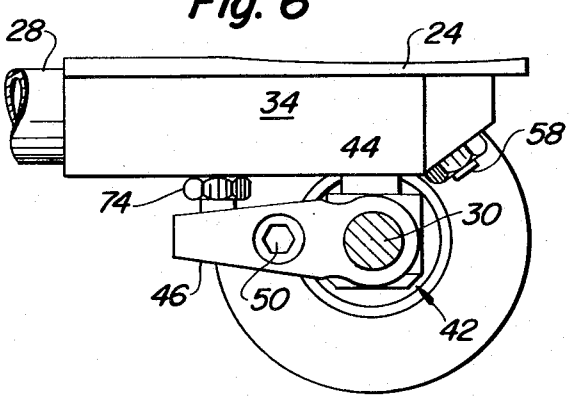
FIG. 6 is an enlarged section as seen along the line 6—6 on FIG. 2.

Reference will be had first to FIG. 1 for a general description of a shoe-skate embodying the invention. The numeral (20) designates the skate frame or chassis, which here carries a typical shoe (22) via front and rear frame parts (24) and (26) respectively, which parts are joined together by a tubular reach or backbone (28). The front and rear parts are respectively supported on front and rear wheeled trucks including front and rear transverse axles (30) and (32), respectively.

The front part (24) may have any suitable means for the mounting of same to the shoe, the details of which are of no importance here. In this case, the front part has rigid therewith a depending support (34), preferably in the form of casting of aluminum or like metal formed with a cylindrical socket (36) on an upright or substantially upright axis. This socket has a closed upper end (38) and opens downwardly at an open bottom end (40) directly above the front axle. Associated with the front axle is an L-shaped structure (42) made up of a pedestal (44) and a tongue (46). The tongue is preferably made up of two mating parts, as best seen in FIG. 9, and has transversely alined openings (48) for receiving the axle (30), in such manner as to be rockable about the axis of the axle. A machine screw (50) secures the two tongue parts together, as via cooperating bores (52), one of which is tapped. The lower part of the pedestal is also cross-drilled to receive the axle (30), as via a press fit so that the axle and pedestal are rigidly joined.

The axis of the axle intersects with the vertical axis of the pedestal and the upper end of the pedestal supportingly engages the front support by means of abutting engagement between the top end of the pedestal and the closed end of the front socket, the pedestal serving as a column to achieve this support. A disk (54) of relatively hard but yieldable non-metallic material such as hard rubber, urethane, etc., is used between the top end of the pedestal and the top end of the socket, the arrangement and dimensioning being such that limited rocking is permitted between the skate and the front axle. The material also contributes to a "clutching" action between the foot or frame parts and the pedestals, at least about a fore-and-aft axis, as will be explained later. The disk serves also to eliminate the need for lubrication. The upper end of the pedestal is in the form of an annular flange or lip (56) concentric with the pedestal so that the intermediate part of the pedestal is reduced in diameter so as to permit the aforesaid limited relative movement. Releaseable means is provided to retain the pedestal against downward escape from the socket. In the present form of the invention, this means includes a set screw (58) threaded into the support at an angle (FIG. 7) and adjustably engaging the flange on the pedestal. A lock nut (60) secures the position of the set screw. The adjustment is such as not to cancel the limited relative movement described above. Other means may be used in place of the set screw and lock nut.

Figure 7:
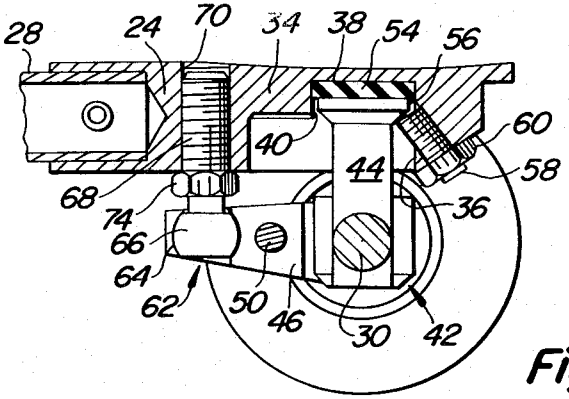
FIG. 7 is a section, drawn to the scale of FIGS. 5 and 6, as seen along the line 7—7 on FIG. 2.

The front axle and its related parts are further mounted to the front support by additional pivot means, here a ball and socket joint (62) (FIG. 7). In the case of the front axle, etc. the tongue (46) projects rearwardly at a level about that of the front axle and has a rear terminal end in which a ball-shaped socket (64) is formed. FIG. 9 shows how the socket is formed of two mating halves to receive a ball (66) formed integrally with the lower end of a screw or equivalent upright member (68) threaded into a tapped bore (70) in the support rearwardly of the pedestal (44). The bottom end of the ball is formed as a hexagonal recess (72), exposed through the open bottom of the socket to provide for the receipt of a mating tool for screwing the screw into and out of the support to vary the location of the ball relative to the meeting ends of the pedestal (44) and socket (36). A suitable lock nut (74) is provided for securing the position of the screw. As respects the ball and socket means, it should be noted that the skater's weight is taken wholly by the pedestal and none of this weight falls on the ball and socket. The skater may select the turning action of the front axle as follows: The relative heights of the ball and the top of the pedestal may be adjusted to vary the angle or pivot about which the front wheels and axle rock relative to the skate frame, and the adjustment is secured by the lock nut (74).

Figure 5:
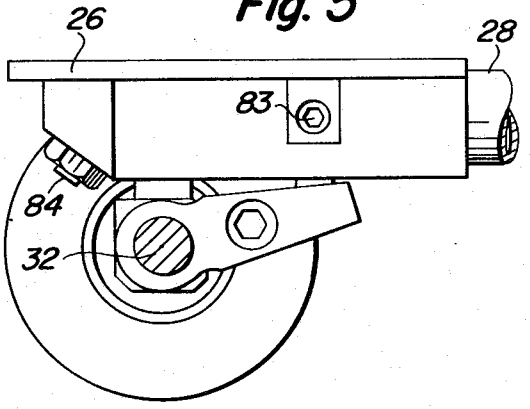
FIG. 5 is an enlarged section as seen along the line 5—5 on FIG. 2.
Figure 8:
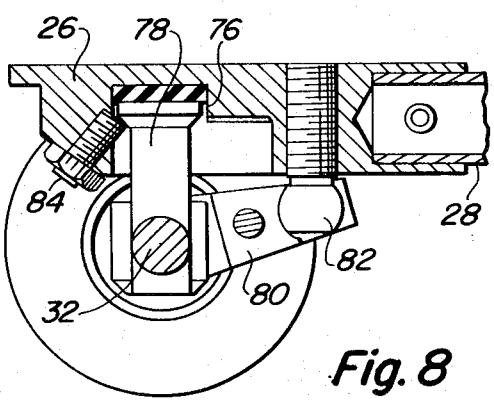
FIG. 8 is a section, on the scale of FIG. 7, as seen along the line 8—8 on FIG. 2.

The rear axle structure follows that of the front structure just described. For example, a rear socket (76) will be seen as receiving a pedestal (78) rigid with the rear axle and with a forwardly extending axle-pivoted tongue (80) having a ball and socket connection (82) with the rear support. A set screw and lock nut combination (84) will be seen as retaining the pedestal as in the case of the front structure. In the rear structure, however, the tongue slopes upwardly and the angle between the ball and socket (82) and the engagement between the upper end of the pedestal and the inner top of the socket is steeper than in the front structure, because the rear axle need not steer to as great an extent as the front axle. The adjustment of the rear screw for selecting turning action is secured by a set screw (83) (FIG. 5). Moreover, the forward extension of the rear tongue means that the rear axle steers oppositely to the front axle, which, as a matter of geometry, is not unconventional.

FIG. 10 shows a modified frame-to-pedestal arrangement with means for limiting rocking of the frame relative to the axle about the pivot axis extended through the top of the pedestal and the associated ball and socket joint. In this form of the design, the pedestal is shown at (90) as rigid with an axle (92). The frame has a depending socket (94) into which the pedestal is received as before. The socket is defined in part by an annular wall (96), and the junction of the pedestal with the axle has an enlarged portion provided with spaced shoulders (98) which extend upwardly into the socket enough to engage with diametrically opposed lower marginal parts of the wall (96) to provide stops limiting rocking of the frame (and skater) relative to the axle and wheels about the aforesaid axis through the top of the pedestal and the associated ball and socket joint.

Rocking action of the shoe to the skate wheels is as close to the bottom of the shoe as possible. This helps to eliminate undesired tilting of the foot. The tilting action is on a relative flat surface directly under the shoe. This eliminates the undesired tilting of the foot, and at the same time the skater can tilt his foot with ease.

The skate is designed so that the trucks of the skates have no turning resistance until such time that weight is applied to the top of the pedestal by pressure or weight of the skater. When pressure is applied, the disk (54) at the front truck and the corresponding disk at the rear serve as clutches to impart turning movement to the respective pedestals, because of the frictional nature of the disk material. The ease of steering is augmented by the pivoting of the tongues (46) and (80) to the respective pedestals at the axes of the respective axles. The avoidance of soft, spongy pads results in elimination of biasing forces tending to return the trucks to straight-ahead positions. When pressure is released wheels do not tend to turn in a straight direction, as others do, but remain in the same pattern until the skate is removed from the floor.

The design of the skate is such that when turning the pressure on the pedestal is always to the inside of the turn being made, therefore developing a condition where wheels nay be set closer together than heretofore. The turning action is adjustable to the skater's needs by means of adjusting the screws (68) and (82) in or out.

FIGS. 11 and 12 show a further modified form of support and pedestal arrangement in which the front support (91) is fitted to a reach or tubular chassis part (93) by means of a socket (95) and set screw (97). The end of the tube may be split and the end of the screw may be tapered so as to expand the tube in the socket and improve the connection. As best seen in FIG. 12, the support may be of cast aluminum formed with a cavity (99) which provides a socket (100) closed at its top at (102) and opening downwardly at (104). This cavity is basically circular as seen from below and serves to receive the top end of a pedestal (106) like those described before. This pedestal has an annular flange (108) and is further formed centrally with a partly-spherical extension (110) which rather tightly receives a centrally apertured disk (112) of material like that described with respect to the disk (54) (FIG. 7). This assures retention of the disk by the pedestal during assembly and disassembly. The height of the extension (110) is below the top surface of the disk so that it does not interfere with the function of the disk. Instead of the retaining means as described earlier, this form of the invention has a washer (114) of rubber or like material fastened in place by a screw (116) and metal washer (118), the washer (114) having a lip engaging under part of the annular flange on the pedestal top. When assembled, the fit is such that the pedestal may have pivotal movement to the extension referred to above. The washer-screw unit is received in an extension cavity (120). The metal washer may be slightly arcuate in section to prevent undue loosening of the screw. The part (91) further has a tapped bore (122) for receiving the threaded upper portion of a ball and socket screw, not shown but which may be like that at (68). This design is repeated for the rear part of the skate. Otherwise, the structures are similar to those described above and retain the features previously pointed out, although possessing advantages from the manufacturing standpoint.

The fact that the distance from the axle and the shoe plate remains constant regardless of any adjustment made to the skate when the limit between (96) and (98) (FIG. 10) is reached, there is approximately one-sixteenth inch between the wheel and the shoe plate. This makes it possible for a much lower skate assembly.

This design makes it possible that the skate may be removed from the floor without there being any force turning the skate wheels straight as there is in practically all other designs. At the same time, when the skate is brought back to the floor, all four wheels will be in contact with the floor before there is any actual weight applied to the skate. And as this weight is applied to the skate, the turning resistance will start to develop on the disk (100). As this turning resistance develops, there is a "clutching" action on the disk; therefore, when this clutching resistance is developed and this slip-page progresses, it damps any possible wobbling or "snaking" of the skate even though this is a very free turning skate. This slipping action damps out the tendency of the skate to turn back to some other position until the skater desires to change the direction of the skate. Or, in other words, which ever way the skate is turned, there is no tendency for the skate to change direction until the skater desires to.

Since it has been established that the shoe plate will rock from side to side without any increasing resistance regardless of how fast a turn the skater is in, therefore it was necessary to establish a turning limit. In other designs of skates, this turning limit was unnecessary because the further the skater turned, the harder it was to tilt the shoe plate. Until such time as the skater could turn no further or tilt the plate on account of the force or resistance on the rubber or the bind on the mechanism.

The foregoing arrangement provides a skate with a narrower wheel tread, adds to the life of the skate wheels, eliminates bias in the movable parts and avoids placing the skater's weight on the ball joints. Further features and advantages will occur to those versed in the art, as will many modifications in the preferred embodiments disclosed, all of which may be achieved without departure from the spirit and scope of the invention.

I claim:

1. A roller skate having a fore-and-aft frame including front and rear shoe-receiving parts respectively carrying front and rear wheeled axles, the improvement to each part comprising a support depending from and rigid with the part and provided with a socket having a closed upper end and an open bottom facing downwardly to the axle, a pedestal disposed between the axle and the socket and having a lower end secured to the axle and a flat top end loosely received in the socket, the pedestal being of fixed height and having its top end spaced below the closed end of the socket, means operative to confine the top end of the pedestal to the socket, a clutching element received in the space between the closed upper end of the socket and the top end of the pedestal, said element being composed of a relatively hard but yieldable material having frictional properties and providing frictional means normally unloaded in the absence of weight on the skate so as to permit relatively free rocking of the pedestal and wheeled axle relative to the frame part about at least a fore-and-aft axis, but frictionally effective as a clutch between the socket and pedestal when the weight of a skater is applied to the skate, said frictional means being releasable upon removal of the skater's weight, a fore-and-aft tongue disposed at about the level of the axle and having one end connected to the axle for rocking relative to the axle and pedestal about a transverse axis and having a terminal end spaced fore and aft from the axle, and adjustment means connected between the terminal end of the tongue and the frame for rocking of the tongue relative to the axle and pedestal about the aforesaid transverse axis.

2. The roller skate of claim 1, in which the vertical centerline of the pedestal intersects the axis of the axle, and the transverse axis between the tongue and pedestal is the axis of the axle.

3. The roller skate of claim 1, in which the top end of the pedestal has an overhanging lip thereon and the confining means engages the lip from below.

4. The roller skate of claim 1, including limit means for limiting rocking of the frame relative to the wheeled axle.

5. The roller skate of claim 4, in which the limit means includes an annular wall coaxial with and depending from the socket in surrounding relation to a lower part of the pedestal adjacent to the axle, and said lower pedestal part is loosely received in the wall, but dimensioned to contact the wall to serve as a stop upon predetermined relative rocking of the socket and pedestal.

6. The roller skate of claim 1, in which the pedestal and socket are cylindrical on a vertical axis and clutching element is in the form of a disk coaxial with the pedestal and having central aperture, and retaining means projects upwardly from the top of the pedestal and into the aperture to retain the disk on the pedestal, said means terminating short of the top face of the disk so as not to interfere with the aforesaid clutching action.

* * * * *